US005556157A

United States Patent [19]

Wempe

[11] Patent Number: 5,556,157

[45] Date of Patent: Sep. 17, 1996

[54] NO-SHEAR POWER RECLINE SYSTEM FOR WHEELCHAIRS

[76] Inventor: Patrick L. Wempe, 204 NW Courtland, Topeka, Kans. 66606-1265

[21] Appl. No.: 360,571

[22] Filed: Dec. 21, 1994

[51] Int. Cl.[6] ..... A47C 1/02

[52] U.S. Cl. ..... 297/68; 297/DIG. 4; 297/423.26

[58] Field of Search ..... 297/68, 71, 90, 297/91, DIG. 4, 358, 362.11, 423.26; 180/907; 280/250.1, 304.1

[56] References Cited

U.S. PATENT DOCUMENTS

| | | | |
|---|---|---|---|
| 2,849,051 | 8/1958 | Streeter, III | 297/361.1 X |
| 3,858,938 | 1/1975 | Kristensson et al. | 297/423.26 X |
| 4,039,223 | 8/1977 | Kristensson | 297/90 |
| 4,333,681 | 6/1982 | Nelson . | |
| 4,339,013 | 7/1982 | Weigt | 297/354.13 X |
| 4,655,471 | 4/1987 | Peek . | |
| 4,966,379 | 10/1990 | Mulholland . | |
| 5,044,647 | 9/1991 | Patterson . | |
| 5,263,768 | 11/1993 | Scheulderman | 297/354.12 X |
| 5,297,021 | 3/1994 | Koerlin et al. . | |

*Primary Examiner*—Milton Nelson, Jr.
*Attorney, Agent, or Firm*—Kokjer, Kircher, Bowman & Johnson

[57] ABSTRACT

This device is primarily designed for use on a powered wheelchair. The device utilizes a back frame (35) with an attached sliding backrest (21). The back frame (35) is electro-mechanically powered and pivotly attaches to the rearward side of seat frame members (32), allowing the back frame (35) to angle away from the seat frame members (32) in a reclining motion. When the back frame (35) reclines, it forces telescoping linkages (7) through seat frame members (32), extending the leg rests (14) forwardly away from the seat frame members (32). By pinning the top of the leg rests (14) back to the seat frame members (32), the forward motion forces the leg rests (14) to articulate in an upward motion. The backrest (21) is also attached to the telescoping linkages (7) by tie rods (15) through slots (34) in the sides of the seat frame members (32). When the telescoping linkages (7) move forward, they pull the backrest (21) with them, eliminating the shearing forces to the occupant. All design advantages and claims will become apparent from a consideration of the ensuing descriptions and drawings.

12 Claims, 2 Drawing Sheets

NO-SHEAR POWER RECLINE SYSTEM FOR WHEELCHAIRS

FIELD OF INVENTION

This invention relates to a power reclining seating system for wheelchairs, specifically, an improved and unique mechanical means of providing a no-shear backrest and articulating leg rests.

BACKGROUND OF THE INVENTION

This invention provides a no-shear backrest assembly and an extending leg rest assembly working together to alleviate pressure and shear-related skin problems. Applicant's invention, utilizing mechanisms on the back, and running through the seat frame, offers floor-to-seat height versatility not existing in the prior art. Other inventions, such as U.S. Pat. No. 4,655,471 (1987) to Peek and U.S. Pat. No. 5,297,021 (1994) to Koerlin et al., contain complicated mechanisms under the seat frame, resulting in an overall floor-to-seat height greater than that of the original wheelchair. This greater seat height restricts accessibility to tables, desks, and transportation. These prior art attachments with their cams, scissor mechanisms, computer controlled actuators and such, are expensive, prohibiting acquisition by many would-be users.

It is an object of the invention that as the back section reclines, the leg rests articulate as well as extend away from the seat base. This action is essential to allow for the natural lengthening of the leg as it is reclining towards the horizontal position—this lengthening is an important factor for reducing shear.

It is also an object of the invention to lower the overall working height of a wheelchair with the said invention attached. Having the mechanical functions on the back, and running directly through the seat frame, allows this invention to provide flexibility concerning overall floor-to-seat height of wheelchairs to which it is attached, reducing accessibility restrictions.

It is further an object of the invention to reduce the weight of the reclining system. This is achieved through an efficient structural and engineering design. Weight reduction reduces wear on the wheelchair while increasing range and performance. This new invention allows for easy access to the wheelchair for service and maintenance without compromising structural integrity. Further benefits of this design include improved reliability through the substantial reduction of moving parts.

It is an additional object of this invention to provide leg rests that are easily removed and reattached for occupant transferring purposes. This invention holds substantial improvements over prior art, due in part, but not limited to, its utilization of a telescoping tubular component running through the seat frame. This through-frame technology eliminates prior arts' usage of various components, such as cams, actuators, linkages, scissor mechanisms, and other external devices, usually found under the seat, to recline the mechanism and activate the leg rests. This new through-frame technology is the basis for reducing the overall height and weight, while refining the entire reclining process.

SUMMARY OF THE INVENTION

This invention is primarily designed for use on and is easily and quickly installable on a powered wheelchair. The invention utilizes a back portion consisting of a back frame with an attached sliding backrest. The back frame is electromechanically powered and pivotly attaches to the rearward side of a seat frame, allowing the back portion to angle away from the seat frame in a reclining motion. When the back frame reclines, it telescopes linkages through the seat frame members, extending the leg rests forwardly away from the seat frame. By pinning the top of the leg rests back to the seat frame, by usage of an adjustable bar, the forward motion forces the leg rests to articulate in an upward motion. The backrest, using tie rods, attaches to the telescoping linkages through slots in the sides of the seat frame members. When the telescoping linkages move forward, they pull the backrest with them, eliminating the shearing forces to the occupant. All design advantages and claims will become apparent from a consideration of the ensuing descriptions and drawings.

DESCRIPTION OF THE PREFERRED EMBODIMENT

Figure 1:
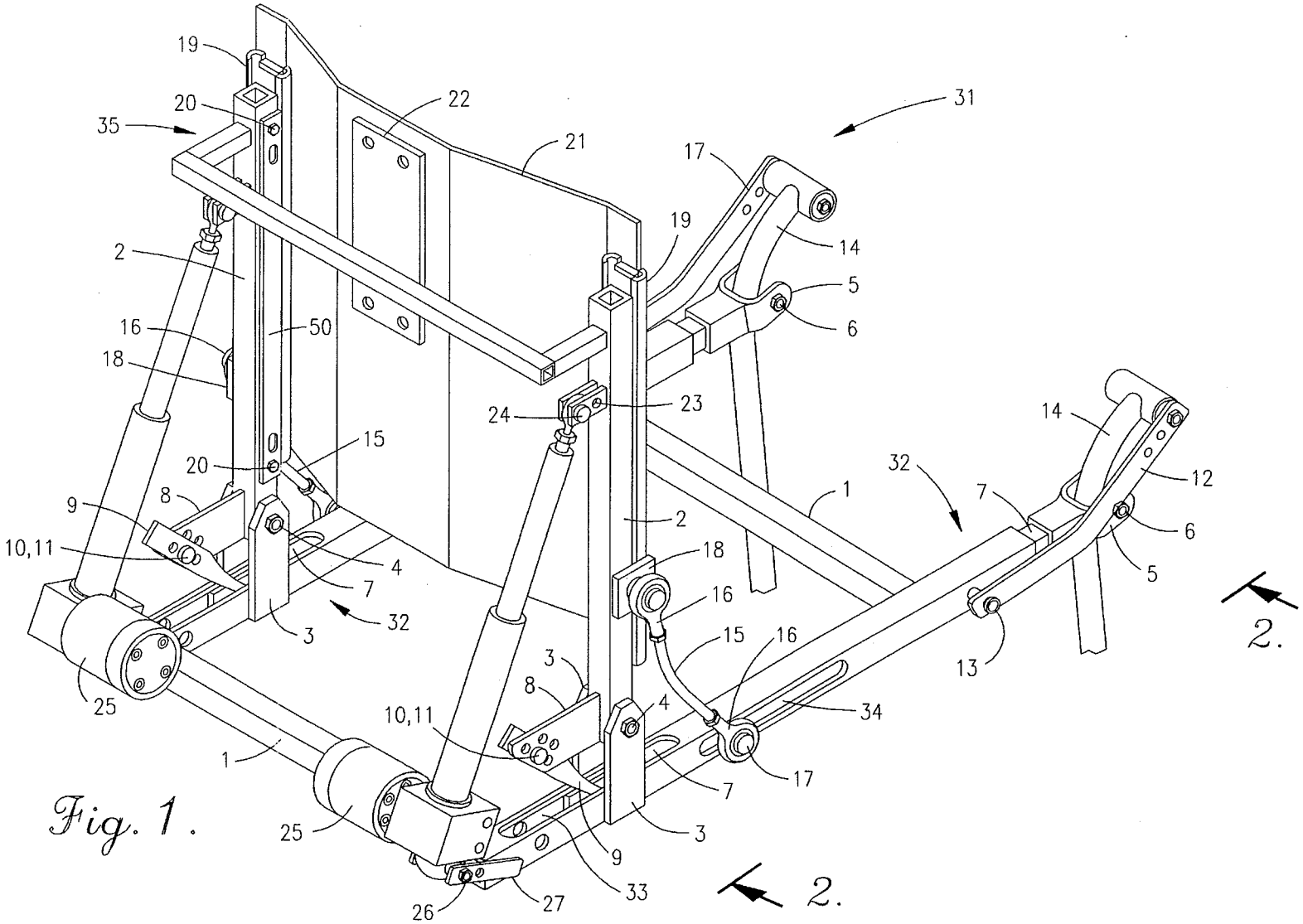
FIG. 1 illustrates a perspective view of the present invention of a power reclining system for a wheelchair.

The present invention will now be described in reference to FIGS. 1–4. FIG. 1 shows a generally symmetrical invention 31 having parallel seat frame members 32 laterally attached together with cross bracing 1. Back frame 35 has parallel laterally-spaced vertical posts 2 with bottom ends connecting to top ends of posts 3 by use of pins 4. The posts 3 attach vertically to the rearward end of horizontal seat frame members 32. Back frame 35 has glides 19 attached to the front side of vertical posts 2 using screws 20. Head rest mount 22 fastens to the middle of the upper back side of backrest 21. A backrest 21 made of conventional wheelchair back materials such as plastic, wood or metal (usually covered with custom upholstery not shown) spans the front of vertical posts 2, supported by glides 19.

Figure 4:
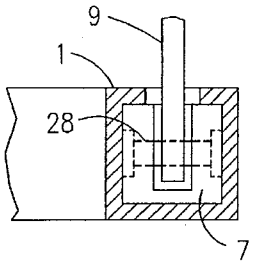
FIG. 4 illustrates a back sectional view of the telescoping linkage taken along line 4—4 in FIG. 2 inside the seat frame member with the connecting linkage pinned to telescoping linkage.

The upper back sides of the vertical posts 2 have receiver mounts 23 which are pivotally secured to the upper ends of the linear actuators 25 to through pins 24. Mounting brackets 27 attach to the back end of seat frame members 32 and support lower ends of linear actuators 25 allowing pivotal movement about pins 26. Adjustment plates 8 are joined to lower back side of vertical posts 2. Connecting linkages 9 attach to adjustment plates 8 using a pin 10 and clip 11. Connecting linkage 9 joins telescoping linkage 7 using a tension pin 28 as shown in FIG. 4.

Figure 2:
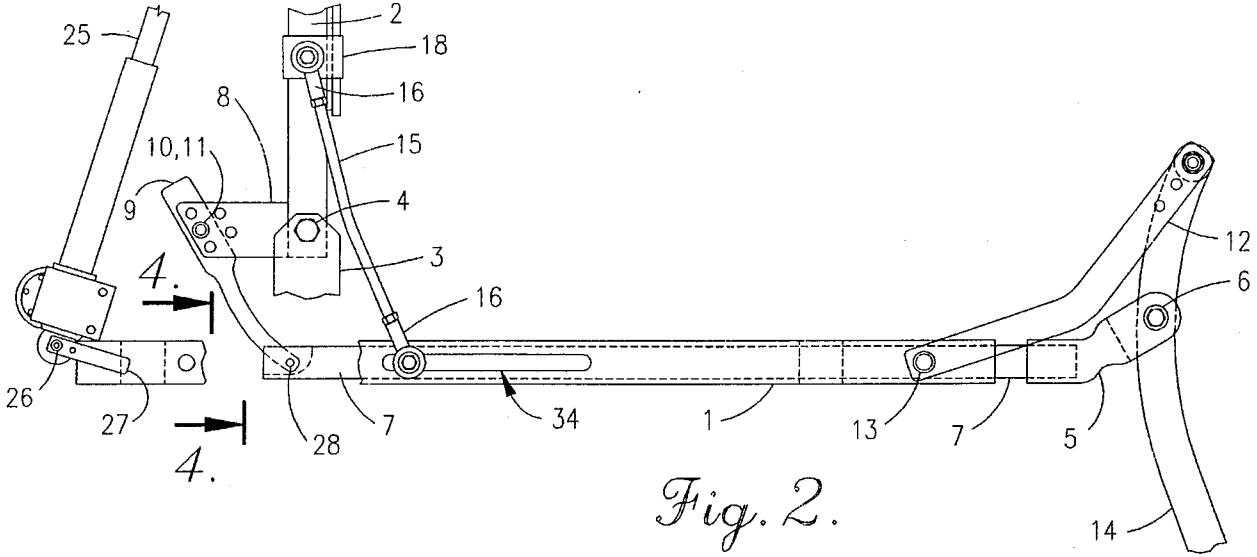
FIG. 2 illustrates a fragmentary side view taken along line 2—2 in FIG. 1 of a seat frame member and associated working mechanisms.
Figure 3:
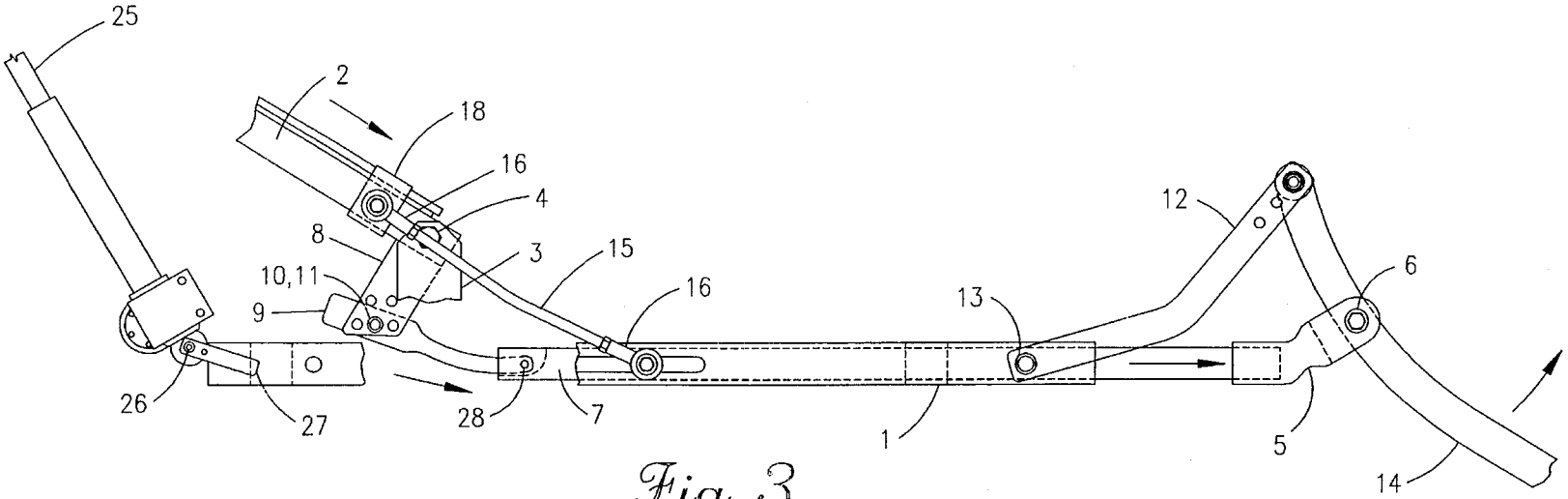
FIG. 3 illustrates a fragmentary side view of the seat frame member and associated working mechanisms of FIG. 2 while in a reclined position; and broken away.

FIG. 2 and FIG. 3 show that when the vertical post 2 of the back frame 35 is pulled rearwardly down to the reclining position by the linear actuator 25, adjustment plate 8 is forced to rotate downwardly around the axis of pin 4. As adjustment plate 8 moves, it forces connecting linkage 9 to extend telescoping linkage 7 forward through seat frame member 32. In the middle of the outward side of seat frame member 32 there is a slot 34 allowing for attachment and movement of tie rod assembly 15 with knuckles 16 using a bolt 17 threaded into telescoping linkage 7. Tie rod assembly 15 with knuckles 16 attaches to weld clip 18. Weld clip 18 is affixed to glide 19 which supports backrest 21. When the invention 31 reclines and forces the telescoping linkages 7 forward, the linkages 7 pull the backrest 21 forward by means of the tie rod assembly 15, weld clip 18 and glide 19, eliminating the shearing forces to the occupant's back. As the invention 31 is returning to an upright position, the action is reversed, forcing the backrest 21 to slide upwards along vertical posts 2. There are cut-outs 33 on the top of the rearward ends of seat frame members 32 allowing adjustment plates 8 and connecting linkages 9 sufficient clearance to complete a rotational arc to fully recline.

Legrest 14 is fastened to yoke 5 by pivot pin 6. One end of adjustment bar 12 attaches to the top end of leg rest 14 and the other end of bar 12 fastens to the forward side of seat frame member 32 using a stud 13. Yoke 5 is received over telescoping linkage 7 which protrudes from the forward end of seat frame member 32, as is clearly shown in FIG. 2. As the invention 31 is reclined by linear actuator 25 the back frame 35 is pulled down. The adjustment plate 8 forces connecting linkage 9 to extend telescoping linkage 7 forward, and to extend yoke 5 and leg rest 14 forward. By pinning the top part of leg rest 14 using adjustment bar 12 attached to a stud 13 mounted to seat frame member 32, the leg rest is also forced to articulate upward as is clearly shown in FIG. 3. When the linear actuator 25 is reversed the entire process is reversed accordingly. It is important to note that changing positions of pin 10 and clip 11 in adjustment plate 8 and connecting linkage 9 changes the overall amount of linear travel induced into the backrest 21 and leg rest 14. Changing where adjustment bar 12 attaches to the top of leg rest 14 changes the amount of upward articulation of the leg rest 14. These adjustments are essential to fitting the invention 31 to a wide variety of users. It is equally important to make clear that the invention 31 is generally symmetrical, having a left and right side connected by cross bracing 1. By varying the length of cross bracing 1, the width of the invention 31 can change to accommodate various widths of users.

I claim:

1. An apparatus for supportably attaching a leg rest to a wheel chair, said leg rest for supporting a leg of a user, said apparatus comprising:

at least one seat frame member;

at least one telescoping linkage slidably received within said seat frame member, said linkage telescoping between a retracted position configured to locate a forward end of said linkage immediately adjacent a forward edge of the seat frame member and an extended position configured to locate said forward end remote from the forward edge of the seat frame member, said linkage moving along a telescoping path parallel to a length of said seat frame member; and at least one leg rest supportably and pivotally mounted at a hinge point directly to said forward end of said telescoping linkage, said leg rest pivoting about said hinge point, said telescoping linkage moving said hinge point and said leg rest along said telescoping path to move said leg rest forward and backward in a direction parallel to said length of said seat frame member.

2. The apparatus of claim 1, wherein said hinge point is located at an intermediate point along a length of said leg rest.

3. The apparatus of claim 1, further comprising an adjustment bar having a first end pivotally mounted to said seat frame member at a first point thereon and a second end acting upon said leg rest at a point remote from said hinge point, said bar maintaining a fixed distance between said first point on said seat frame member and said remote point on said leg rest to force said leg rest to rotate about said hinge point as said linkage telescopes between said retracted and extended positions.

4. The apparatus of claim 1, wherein said hinge point is located proximate a forward end of said seat frame member when said linkage is in said retracted position, and said hinge point is located remote from said forward end of said seat frame member when said linkage is in said extended position.

5. An apparatus for attachment to a wheelchair, comprising:

at least one seat frame member;

at least one telescoping linkage slidably received within said seat frame member, said linkage telescoping between a retracted position configured to locate a forward end of said linkage immediately adjacent a forward edge of the seat frame member and an extended position configured to locate said forward end remote from the forward edge of the seat frame member, said linkage moving along a telescoping path parallel to a length of said seat frame member;

at least one leg rest supportably and pivotally mounted at a hinge point directly to said forward end of said telescoping linkage, said leg rest pivoting about said hinge point, said telescoping linkage moving said hinge point and said leg rest along said telescoping path to move said leg rest forward and backward in a direction parallel to said length of said seat frame member;

a back frame for supporting a back of a user, said back frame including a bottom end pivotally mounted to said seat frame member;

extension means for forcing said telescoping linkage to extend forward from said seat frame member; and retraction means for forcing said telescoping linkage to retract rearward into said seat frame member.

6. The apparatus of claim 5, wherein said hinge point is located at an intermediate point along a length of said leg rest.

7. The apparatus of claim 5, further comprising an adjustment bar having a first end pivotally mounted to said seat frame member and a second end acting upon said leg rest at a point remote from said hinge point, said bar forcing said leg rest to rotate about said hinge point as said linkage telescoping between said retracted and extended positions.

8. The apparatus of claim 5, wherein said hinge point is located proximate a forward end of said seat frame member when said linkage is in said retracted position, and said hinge point is located remote from said forward end of said seat frame member when said linkage is in said retracted position, and said hinge point is located remote from said forward end of said seat frame member when said linkage is in said extended position.

9. The apparatus of claim 5, additionally includes:

glide means supporting a backrest allowing for reciprocating sliding movement of said backrest in relation to said back frame; and means for reciprocating sliding movement of said backrest such that said backrest slides downward toward a bottom end of said seat frame member when said back frame pivots toward a reclined position and such that said backrest slides upward away from the bottom end of the seat frame member when the back frame pivots toward an upright position.

10. The apparatus of claim 9, wherein said means for reciprocating sliding movement comprises tie rods attached between said glide means and said telescoping linkage in a manner to enable sliding movement of said backrest as said back frame pivots from reclined to upright positions and vice versa.

11. The apparatus of claim 5, wherein said extension means includes a connecting linkage mounted to said back frame and having an outer end which engages a rear end of said telescoping linkage to drive said telescoping linkage toward said extended position as said back frame pivots toward a reclined position.

12. The apparatus of claim 11, wherein said retraction means includes a rod assembly having a first end secured to said back frame and a second end secured to said telescoping linkage, said rod assembly pulling said telescoping linkage toward said retracted position as said back frame pivots toward an upright position.

* * * * *